US007621004B2

(12) United States Patent
Lobry et al.

(10) Patent No.: US 7,621,004 B2
(45) Date of Patent: Nov. 24, 2009

(54) TRIPOD SLAT END PIECE WITH A HIGHLY STABILISED RANGE OF MOVEMENT

(75) Inventors: Jacques Lobry, Bourges (FR); Jean-Jacques Bonnefoy, Bourges (FR); Christophe Tat, Bourges (FR)

(73) Assignee: Tournadre Sa Standard Gum, Bourges (FR)

( * ) Notice: Subject to any disclaimer, the term of this patent is extended or adjusted under 35 U.S.C. 154(b) by 0 days.

(21) Appl. No.: 11/919,522

(22) PCT Filed: Apr. 27, 2006

(86) PCT No.: PCT/FR2006/050395

§ 371 (c)(1),
(2), (4) Date: Mar. 20, 2008

(87) PCT Pub. No.: WO2006/114553

PCT Pub. Date: Nov. 2, 2006

(65) Prior Publication Data

US 2009/0126106 A1 May 21, 2009

(30) Foreign Application Priority Data

Apr. 27, 2005 (FR) ..... 05 04257

(51) Int. Cl.
*A47C 23/06* (2006.01)

(52) U.S. Cl. ..... 5/238; 5/236.1; 5/239

(58) Field of Classification Search ..... 5/236.1, 5/237, 238, 239, 241, 242, 244
See application file for complete search history.

(56) References Cited

U.S. PATENT DOCUMENTS

| | | | | |
|---|---|---|---|---|
| 5,924,149 | A * | 7/1999 | Weber | 5/238 |
| 6,073,281 | A * | 6/2000 | Huber | 5/238 |
| 6,219,863 | B1 * | 4/2001 | Loberg et al. | 5/236.1 |
| 6,237,170 | B1 * | 5/2001 | Salens | 5/236.1 |
| 6,877,174 | B2 * | 4/2005 | Lobry | 5/238 |
| 7,069,606 | B2 * | 7/2006 | Verschuere et al. | 5/236.1 |

FOREIGN PATENT DOCUMENTS

| | | | |
|---|---|---|---|
| EP | 428227 | A1 * | 5/1991 |
| EP | 0 761 138 | A | 3/1997 |
| FR | 2 757 754 | A | 7/1998 |
| FR | 2 854 313 | A | 11/2004 |

* cited by examiner

*Primary Examiner*—Michael Trettel
(74) *Attorney, Agent, or Firm*—Kenyon & Kenyon LLP

(57) ABSTRACT

The invention relates to a suspension device for bed-base slats which is formed by an end-piece which has an upper portion which comprises at least one receptacle to receive the end of a slat, a lower portion which is provided with means for anchoring the said end-piece to a bed frame, and an intermediate portion which comprises suspension members which connect the lower portion to the upper portion. The suspension members comprise at least one longitudinal wall which is able to fold at a substantially longitudinally extending fold line, and at least one transverse wall which is able to fold at a substantially transversely extending fold line.

16 Claims, 5 Drawing Sheets

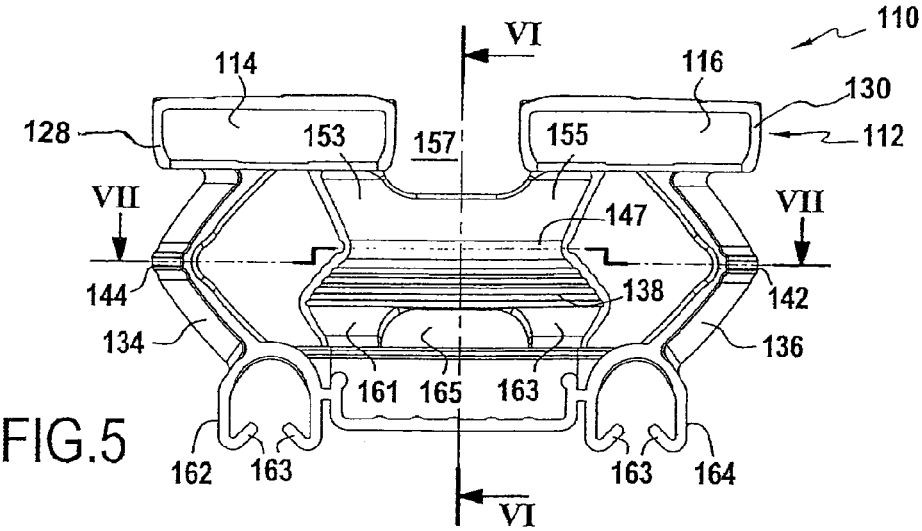
FIG.5
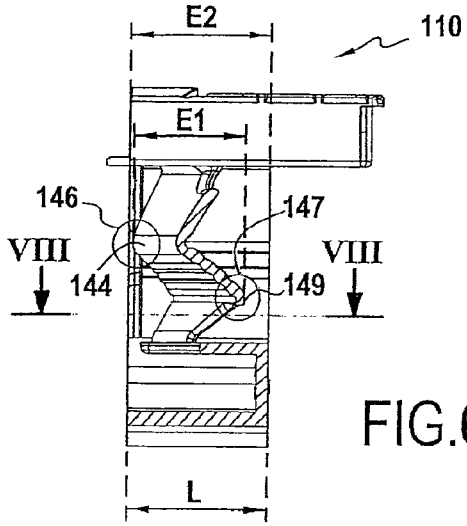
FIG.6
FIG.8
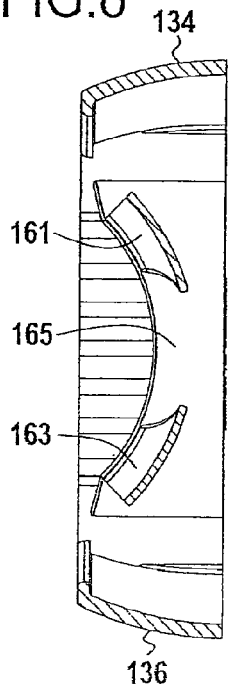
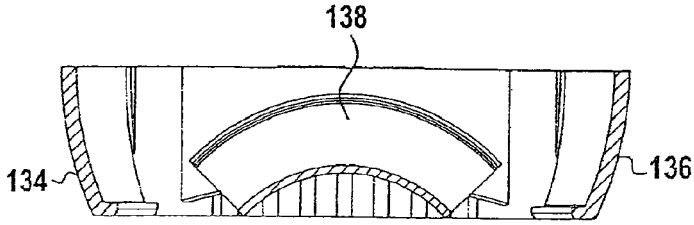
FIG.7

TRIPOD SLAT END PIECE WITH A HIGHLY STABILISED RANGE OF MOVEMENT

This is a 371 national phase application of PCT/FR2006/050395 filed 27 Apr. 2006, claiming priority to French Patent Application No. FR 0504257 filed 27 Apr. 2005, the contents of which are incorporated herein by reference.

FIELD OF THE INVENTION

The invention relates to the field of the elastic suspension of slats for a slatted bed base.

BACKGROUND OF THE INVENTION

To be more exact, it relates to a device for suspending bed-base slates which is formed by an end-piece having an upper portion which comprises at least one receptacle to receive the end of a slat, a lower portion which is provided with means for anchoring the said end-piece to a bed frame, and an intermediate portion comprising suspension members which connect the lower portion to the upper portion.

A device of this kind is generally fixed to a side rail of a bed frame.

The known end-pieces can be divided into two main families.

The first family is formed by end-pieces of which the suspension members are arranged in the longitudinal direction of the side rail. These suspension members may comprise one or more superimposed ovals which are capable of folding down on themselves when a vertical load is applied to the end-piece.

In this first family, the suspension members are generally formed from a flexible material which provides flexible suspension.

Also, the arrangement of the members makes it possible for the phenomenon of roll to be prevented, i.e. a rocking movement in a plane parallel to the slats and perpendicular to the side rail.

The second family is formed by end-pieces whose suspension members are arranged perpendicularly to the side rail, such as those which are described in the French patent application which has been published in the present applicant's name as no. FR 2 854 313. The suspension members of end-pieces of this kind provide a large amount of travel, which is more comfortable for the user.

In this second family, the suspension members are generally formed from a rigid material to support the stresses applied to the end-piece.

Also, the arrangement of the suspension members enables the phenomenon of pitching to be prevented, i.e. a rocking movement in a plane orthogonal to the slats and parallel to the side rail.

SUMMARY OF THE INVENTION

The object of the invention is to combine the advantages of end-pieces belonging to both the families described above, in order to provide an end-piece which is more stable.

The invention achieves its object by virtue of the fact that the suspension members comprise at least one longitudinal wall which is capable of folding at least one fold line which extends substantially longitudinally, and at least one transverse wall which is capable of folding at a fold line which extends substantially transversely.

What is meant by longitudinal wall is a wall which extends substantially in the longitudinal direction of the end-piece, which is also preferably the longitudinal direction of the side rail of the bed.

By transverse wall is meant a wall which extends substantially in the transverse direction of the end-piece, which is also preferably a direction orthogonal to the longitudinal direction of the side rail.

The end-piece according to the invention is preferably fixed to the side rail in such a way that the slat which it receives extends substantially perpendicularly to the longitudinal direction of the side rail.

Generally speaking, the longitudinal direction is thus orthogonal to the direction of insertion of the slats whereas the transverse direction is parallel to the direction of insertion of the slats.

The invention thus combines the advantages of end-pieces belonging to both the families described above for the purpose of improving the stability of the suspension device and of avoiding the roll and pitching effects which are found with end-pieces belonging to the families described above.

The suspension members advantageously comprise a pair of transverse walls, and one longitudinal wall which is arranged substantially between the two transverse walls.

The transverse walls are preferably arranged at the ends of the end-piece and the longitudinal wall is arranged substantially in the centre of the end-piece, when looking in its longitudinal direction.

The association of two transverse walls enables the load distribution to the different walls to be improved and necessarily improves the stability of the suspension device according to the invention.

Looking in the transverse direction of the end-piece, the transverse span of the longitudinal wall, when it is folded or unfolded, is advantageously substantially equal to or slightly smaller than the width of the lower portion.

Hence, looking in the transverse direction of the end-piece, the longitudinal wall is contained within a volume of space bounded by two parallel planes which pass through the ends of the lower portion.

This being the case, the transverse span of the longitudinal wall, even when it is in the folded position, is at most equal to the width of the lower portion.

It can thus be seen that, thanks to the device according to the invention, the transverse size of the longitudinal wall (i.e. its size looking in the transverse direction of the end-piece) is smaller than it is in prior art end-pieces.

The width of each of the transverse walls, looking in the transverse direction of the end-piece, is advantageously substantially equal to or slightly smaller than the width of the lower portion.

It can thus be seen that the transverse size of the suspension members is at most equal to the width of the lower portion.

The width of the lower portion generally corresponds to the width of the anchoring means.

In particular, this advantageous provision enables the end-pieces to be fixed against the inside face of the side rail, without the suspension members being able to come into abutment against the side rail when a load is applied to the end-piece.

It also enables an end-piece to be fixed onto the top edge of a side rail, in such a way that the transverse size of the walls is at most equal to the thickness of the side rail.

Looking in the transverse direction of the end-piece, the longitudinal wall advantageously comprises at least one angled portion in such a way as to define a fold line.

It will be appreciated that the fold line is the line about which the longitudinal wall folds when a load is applied to the end-piece.

In a first embodiment, the longitudinal wall comprises a single angled portion.

This single angled portion is preferably so orientated that it opens towards the outside of the bed frame.

In a second embodiment, the longitudinal wall also comprises a second angled portion, which defines a second fold line, the said portion being so orientated that it opens towards the inside of the bed frame.

It can thus be seen that the longitudinal wall, when seen in cross-section in a plane of section transverse to the end-piece, is substantially in the form of a zigzag or an "S" which is capable of folding down on itself when a load is applied to the end-piece.

Since the longitudinal wall is capable of folding down on itself, it will be appreciated that the transverse size of this wall is virtually the same whatever the load applied to the end-piece.

It will also be appreciated that the fact of providing a second angled portion which defines a second fold line enables the travel of the longitudinal wall to be increased while still retaining the advantage of the small transverse size.

Without exceeding the scope of the invention, it is possible for additional angled portions to be provided which open alternately towards the inside and outside of the bed frame, in order to further increase the travel of the longitudinal wall while still retaining the advantage of the small transverse size.

When projected orthogonally onto a reference plan parallel to the slat, the fold line in the longitudinal wall is advantageously curved.

What is meant by a reference plane is a plane which is parallel to the larger face of the slat. This plane is preferably horizontal.

The projected curve is preferably part of an arc which opens towards the inside of the bed frame.

This fold line advantageously enables the stability of the longitudinal wall to be further improved by preventing roll on the part of the upper portion.

When projected orthogonally onto a reference plane parallel to the slat, the fold line in the transverse wall is advantageously curved.

The projected curve is preferably part of an arc which opens towards the inside of the intermediate portion of the end-piece.

This curved fold line advantageously enables the stability of the transverse wall to be further improved by preventing pitching on the part of the upper portion.

The upper portion preferably comprises two receptacles to receive the ends of two slats.

The longitudinal wall also advantageously comprises two upper arms which are connected each to a respective one of the receptacles.

One of the receptacles is preferably connected to one of the transverse walls and to one of the upper arms, whereas the other receptacle is connected to the other transverse wall and to the other upper arm.

Thus, thanks to the two upper arms, each of the two receptacles is advantageously able to move substantially independently of the other, which enables the two slats to be decoupled from one another mechanically, each of them being able to be damped independently of the other.

The longitudinal wall advantageously also comprises two lower arms which are connected to the lower portion, to improve still further the decoupling between the slats.

In a variant, a supporting platform for a mattress is arranged above the two receptacles.

This supporting platform may be formed from a non-slip material to enable the mattress to be held in position.

In another variant, each of the receptacles comprises an extension which forms a supporting portion for a mattress.

The lower portion preferably also comprises an additional receptacle to receive the end of a lower slat.

In a variant, the anchoring means comprise at least one spigot which is intended to fit into a hole made in the bed frame.

In another variant, the anchoring means comprise at least one sleeve to be fixed to a spigot secured to the bed frame.

BRIEF DESCRIPTION OF THE DRAWINGS

The invention will be better understood, and its advantages will be more readily apparent, from perusal of the following detailed description of embodiments, which are given by way of non-limiting example. The description refers to the accompanying drawings, in which:

FIG. 5 shows the second embodiment of end-piece according to the invention.

FIG. 6 is a view in section from the side of the second embodiment of end-piece in plane of section VI-VI which can be seen in FIG. 5.

FIG. 7 is a view in section of the second embodiment of end-piece in plane of section VII-VII which can be seen in FIG. 5, showing the fold lines in the walls among which is a first fold line in the longitudinal wall.

FIG. 8 is a view in section of the second embodiment of end-piece in plane of section VIII-VIII which can be seen in FIG. 6, showing the fold lines in the walls among which is a second fold line in the longitudinal wall.

DETAILED DESCRIPTION

Figure 1:
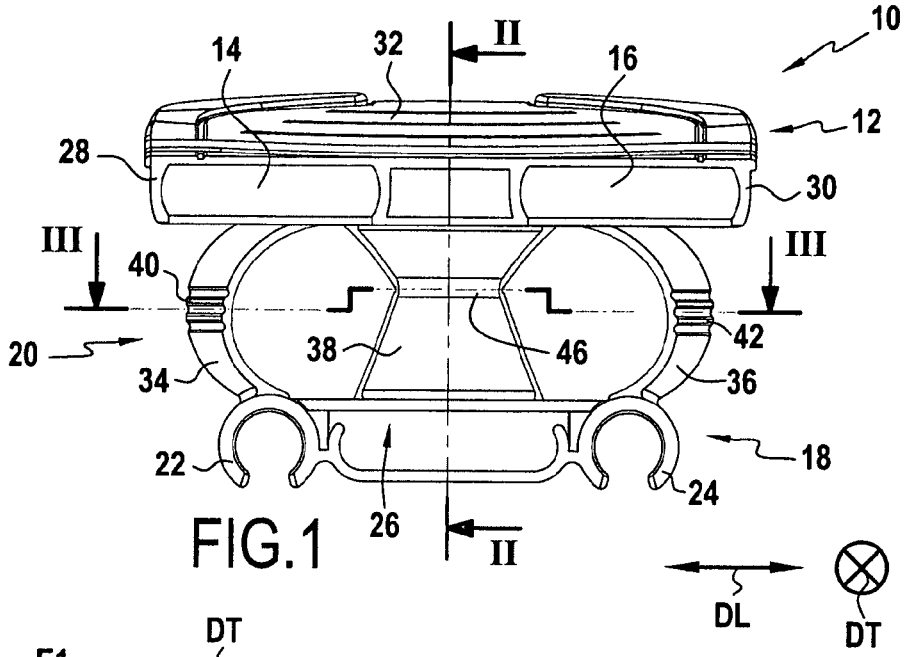
FIG. 1 is a view from the front of the first embodiment of end-piece according to the invention.

The first embodiment of end-piece according to the invention will first be described by reference to FIGS. 1 to 4.

The end-piece 10 according to the invention, which is advantageously produced all in one piece from an elastomeric material, has an upper portion 12 which comprises two receptacles 14 and 16 to receive the ends of two parallel slats, and a lower portion 18 which is provided with anchoring means for the purposes of fixing to a side rail 15.

The end-piece also comprises an intermediate portion 20 which connects the upper portion 12 to the lower portion 18.

The end-piece 10 has a vertical plane of symmetry which is defined by line II-II is FIG. 1.

For convenience, the direction longitudinal DL of the end-piece is defined as the direction orthogonal to the slats and parallel to the longitudinal direction of the side rail 15.

Similarly, the transverse direction DT of the end-piece is defined as the direction orthogonal to the longitudinal direction of the side rail and parallel to the slats.

In a variant, the anchoring means preferably comprise two sleeves 22 and 24 which extend substantially in the transverse direction of the end-piece.

Figure 2:
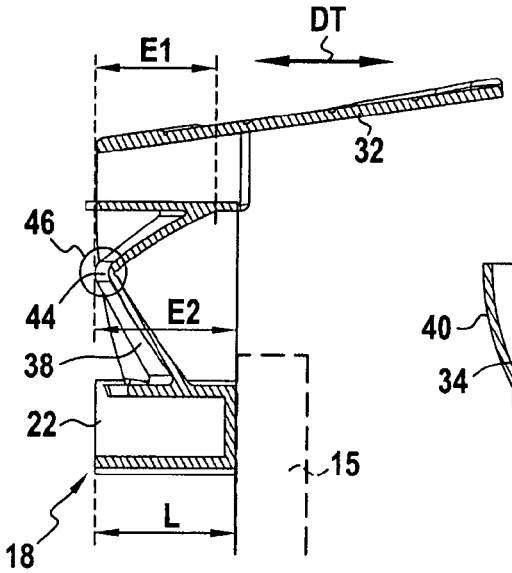
FIG. 2 is a view in cross-section of the first embodiment of end-piece, taken in plane of section II-II which can be seen in FIG. 1.

As can be seen from FIG. 1, in cross-section the sleeves are substantially in the shape of a "C" and are of a length "L" which can be seen in FIG. 2 and which preferably constitutes the width of the lower portion 18.

These sleeves are intended to co-operate with spigots which are fixed in place in a side rail.

The lower portion 18 also comprises an additional receptacle 26 intended to receive a lower slat.

The upper portion 12 comprises two parallel junction pieces 28 and 30 which define the receptacles 14 and 16.

Figure 4:
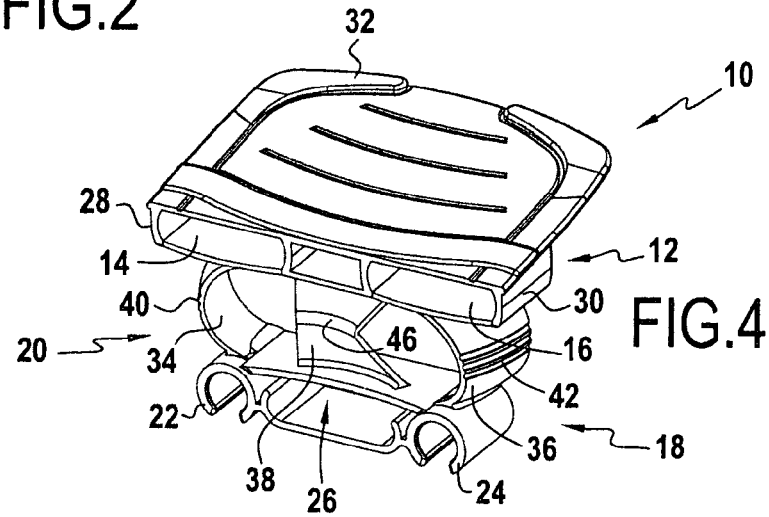
FIG. 4 is a perspective view of a variant of the first embodiment of end-piece according to the invention.

As can be seen from FIG. 4, a supporting platform 32 is arranged above the junction pieces 28, 30 and has an extension in the transverse direction of the end-piece 10 while sloping up slightly. The supporting platform 32 is suitable for receiving a mattress which is not shown here. Also, the platform 32 is preferably formed from a non-slip material which serves to hold the mattress in position.

According to the invention, the intermediate portion 20 comprises suspension members which take the form of walls 34, 36, 38 which connect the lower portion 18 to the upper portion 12.

To be more exact, the said suspension members preferably comprise two transverse walls 34, 36 which are arranged at each of the ends of the end-piece 10 when it is seen in its longitudinal direction.

The presence of these two transverse walls 34, 36 enables makes it possible to restrict the pitching of the upper portion relative to the lower portion, i.e. a rocking movement in a plane orthogonal to the plane of symmetry of the end-piece 10 and substantially parallel to the side rail 15.

Each of the said transverse walls 34, 36 extends substantially in the transverse direction of the end-piece 10, and is able to fold at a fold line 40, 42 which extends substantially transversely.

As can be seen from FIG. 1, in which the end-piece is seen from the front, each of the transverse walls can be seen to be substantially of a form which curves in the shape of a "C" which opens towards the inside of the intermediate portion 20 of the end-piece 10.

Figure 3:
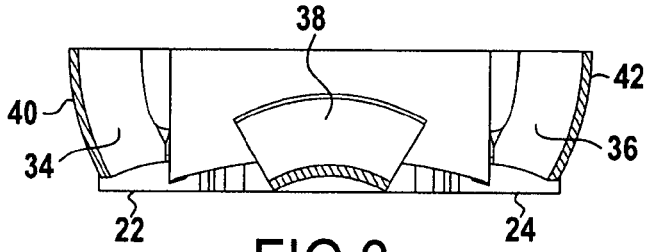
FIG. 3 is a view in section of the first embodiment of end-piece, taken in plane of section III-III which can be seen in FIG. 1, showing the fold lines in the walls.

The fold lines 40, 42 can be seen in particular in FIG. 3, which is a section on line III-III taken in a plane parallel to a reference plan for the slats, the said plane being parallel to the larger face of the slats and, in the present case, substantially horizontal.

As can be seen from FIG. 3, the curvature of the fold lines 40, 42 opens towards the inside of the intermediate portion 20.

The curvature of the fold lines 40, 42 in the transverse walls 34, 36 is advantageous in that it enables roll to be prevented, i.e. a rocking movement in the plane of symmetry II-II of the end-piece 10.

The suspension members also comprise a longitudinal wall 38 which extends substantially in the longitudinal direction of the end-piece 10.

This longitudinal wall 38, which can be seen in FIGS. 1 to 4, is able to fold at a fold line 44 which extends substantially longitudinally relative to the end-piece 10.

As can be seen from FIG. 1, the longitudinal wall 38 has an angled portion 46 which opens towards the outside of the bed frame (which is not shown in FIG. 1), this angled portion being arranged substantially in a central part of the intermediate portion 20.

It will be appreciated that the fold line 44 is formed along the angled portion 46 and that the longitudinal wall 38 is therefore able to fold around the angled portion 46.

To restrict pitching even further, the fold line 44 in the longitudinal wall, when projected orthogonally onto a reference plan for the slats, is in the form of a curve which opens towards the inside of the bed frame.

By reference to FIG. 2, a benefit of the particular form taken by the longitudinal wall 38 will now be explained in more detail.

As can be seen from FIG. 2, the lower portion 18 is of a width "L".

The transverse span of the longitudinal wall 38 is called "E1" and the width of the transverse walls 34, 36, when seen in the transverse direction of the end-piece 10, is called "E2".

According to the invention, the transverse span "E1" and the width "E2" are preferably at most equal to the width "L" of the lower portion 18, in such a way as to minimise the transverse size of the suspension members 34, 36, 38.

In particular, by virtue of this advantageous form, it will be appreciated that when a vertical load is applied to the end-piece 10, the longitudinal wall 38 folds down on itself in such a way that it remains substantially within a volume of space bounded by planes parallel to the plane of symmetry which pass through the transverse ends of the lower portion.

At the very least, it is desirable for the longitudinal wall 38 not to extend transversely beyond this volume in the direction of the side rail.

In particular, when a vertical load is applied to the end-piece 10, the longitudinal wall does not come into contact with the side rail 15 to which the end-piece 10 is fixed, thus making it possible for the end-piece 10 to be fixed to a face of the side rail 15 which is on the inside of the bed frame.

The second embodiment of end-piece according to the invention is shown in FIGS. 5 to 8.

Parts which are identical to those in the first embodiment have been given the same reference numerals but increased by one hundred.

The end-piece 100 of the second embodiment is distinguished principally by the form of the longitudinal wall 138.

As can be seen from FIG. 6, by comparison with the longitudinal wall 38 in the first embodiment the said wall 138 comprises a second angled portion 147, which means that, in the plane of symmetry, the general shape of this wall in section is that of a zigzag or an "S".

Figure 10:
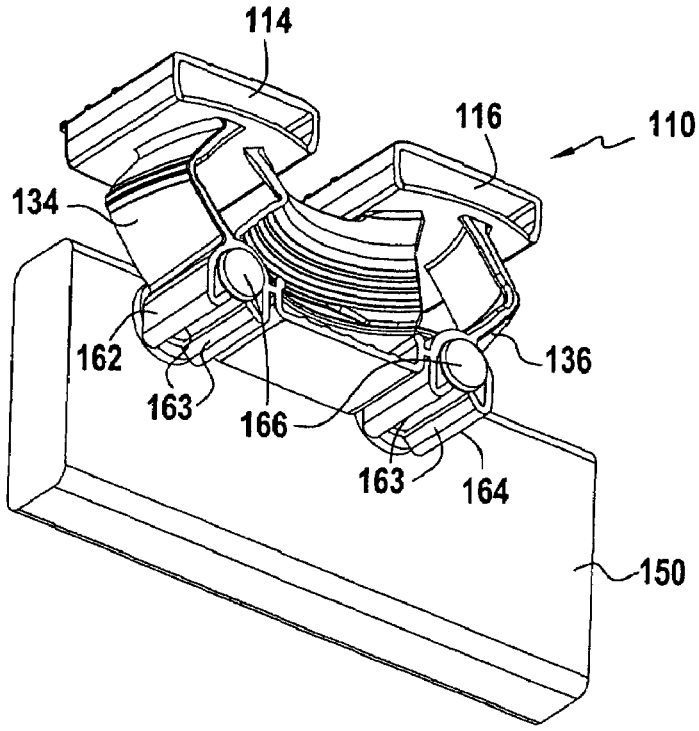
FIG. 10 is a perspective view of the variant end-piece shown in FIG. 9.

The second angled portion is so arranged that it opens towards the inside of the bed frame to which the end-piece 100 is fixed, as can be seen from FIG. 10.

It will also be appreciated that the second angled portion defines a second fold line 149 for the wall 138.

The transverse span of the longitudinal wall 138, when seen in the transverse direction of the end-piece 100, is the maximum transverse distance which exists between the two fold lines 144 and 149.

It will be appreciated that when a vertical load is applied to the end-piece 100, the longitudinal wall 138 is able to fold down on itself in such a way that its transverse size remains virtually the same whatever the load applied to the end-piece 100.

Figure 9:
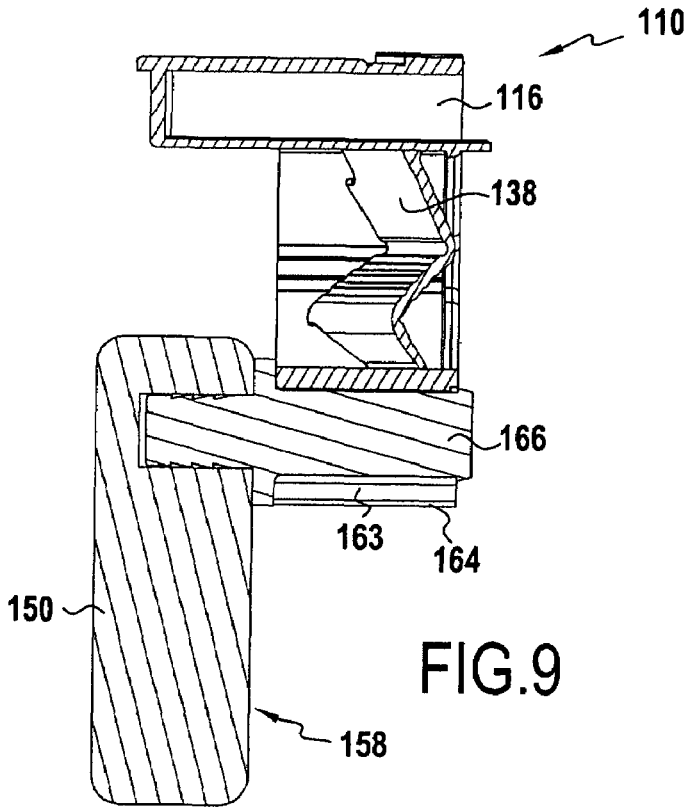
FIG. 9 is a view in section from the side of a variant of the second embodiment of end-piece according to the invention, when the latter is fixed to the side rail.

As can be seen from FIG. 9, the advantage that the particular form of the longitudinal wall 138 has is that it does not come into abutment against the inside face 158 of the side rail 150 to which the end-piece 100 is fixed.

This zigzag or "S" shaped form also enables the height of the longitudinal wall to be increased, i.e. the travel of the suspension formed by the longitudinal wall 138 to be increased.

For their part, FIGS. 7 and 8 show the fold lines 140 and 142 in the transverse walls 134, 136, and the fold lines 144 and 149 in the longitudinal wall 138.

When projected orthogonally onto the plane of reference for the slats, the form of both the fold lines 144 and 149 in the longitudinal wall 138 is that of a curve which opens towards the inside of the bed frame.

In the second embodiment, the longitudinal wall 138 advantageously comprises a pair of upper arms 153, 155 which define between them an upper cut-out 157 which connects the body of the longitudinal wall to each of the junction pieces 128 and 130.

As can be seen from FIG. 5, each of the junction pieces 128, 130 is connected on the one hand to one of the transverse walls 134, 136, and on the other hand to one of the upper arms 153, 155, in such a way that the junction pieces, and hence the slats, are substantially decoupled from one another mechanically.

It will be appreciated that, the larger is the cut-out 157 defined between the two upper arms 153, 155, the greater is the mechanical decoupling.

It is therefore possible to act on the size of the cut-out 157 to adjust the mechanical decoupling of the slats.

The longitudinal wall 138 preferably also comprises a pair of two lower arms 161, 163 which define between them a lower cut-out 165.

It will be appreciated that the longitudinal wall is thus connected to the lower portion 118 via the two lower arms 161, 163.

The lower cut-out 165 enables the mechanical decoupling between the slats to be further improved.

FIGS. 5, 9 and 10 show another variant of the sleeves of the end-piece for fixing it to the side rail 150.

The anchoring means concerned here comprise sleeves 162, 164 whose general shape is that of a inverted "U" whose sides 163 are bent round towards the inside of the "U".

Each of the sleeves 162, 164 is suitable for co-operating with a spigot 166 fixed into the side rail 150, as shown in FIG. 9.

It will be appreciated that the particular form taken by the sleeves 162, 164 enables them to be fixed to the spigots 166 quickly: the curved-round sides 163 deform by curving to a greater extent as the spigot 166 passes between them and then return to their original position, thus preventing the spigot 166 from escaping from the sleeve 162, 164 concerned.

Figure 11:
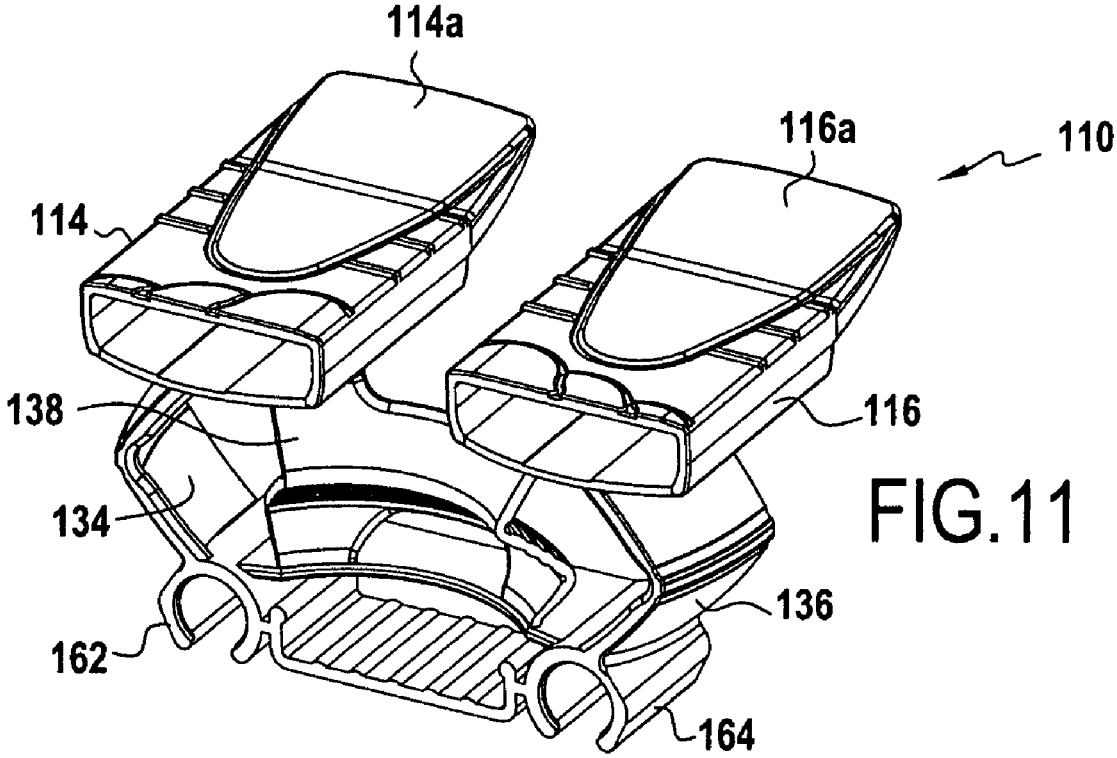
FIG. 11 is a perspective view of another variant of the second embodiment of end-piece according to the invention.
Figure 12:
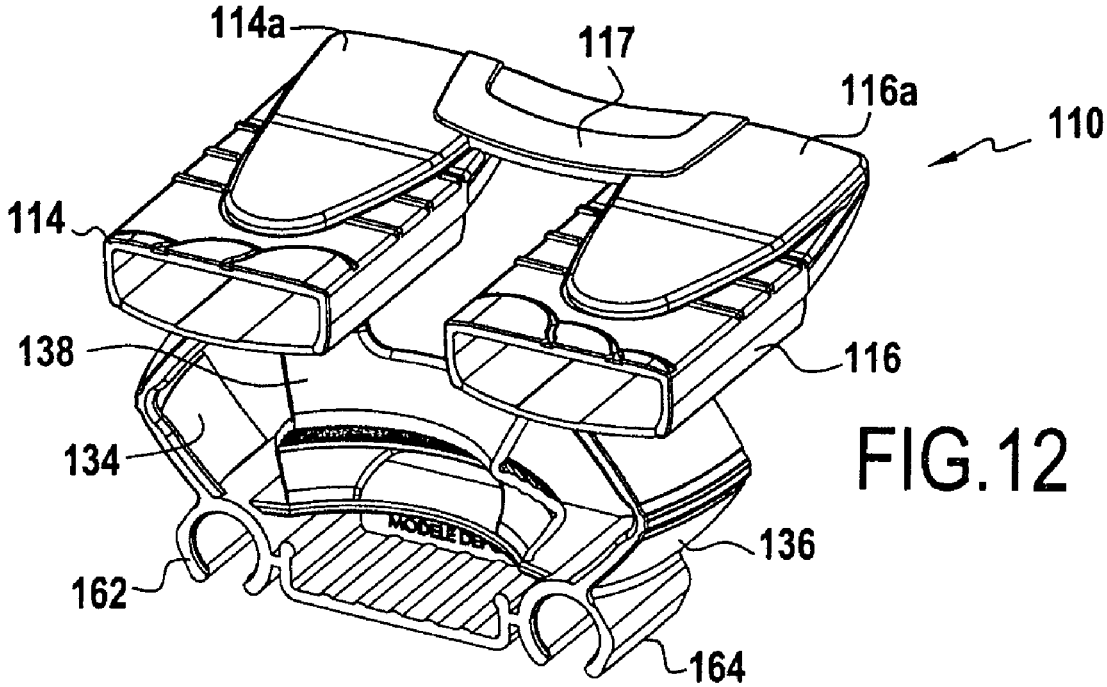
FIG. 12 is a perspective view of another variant of the second embodiment of end-piece according to the invention.

FIGS. 11 and 12 show variants of the supporting platform 32.

FIG. 11 shows receptacles 114, 116 comprising extensions 114*a* and 116*a*, which are intended to form two half supporting platforms for a mattress (not shown).

FIG. 12 shows another variant of the supporting platform 117 which connects the extensions 114*a* and 116*a*.

Figure 13:
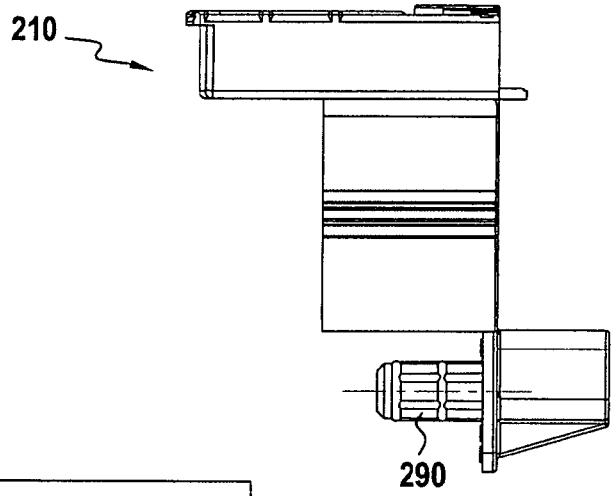
FIG. 13 is a view from the side of the end-piece according to the invention, showing a first variant of the anchoring means.

In FIG. 13 is shown a variant of the anchoring means of the end-piece according to the invention 200.

The anchoring means comprise a single spigot 290 which extends in the transverse direction of the end-piece 200, below the suspension members. This single spigot 290 is also arranged substantially in the centre of the lower portion.

Figure 14:
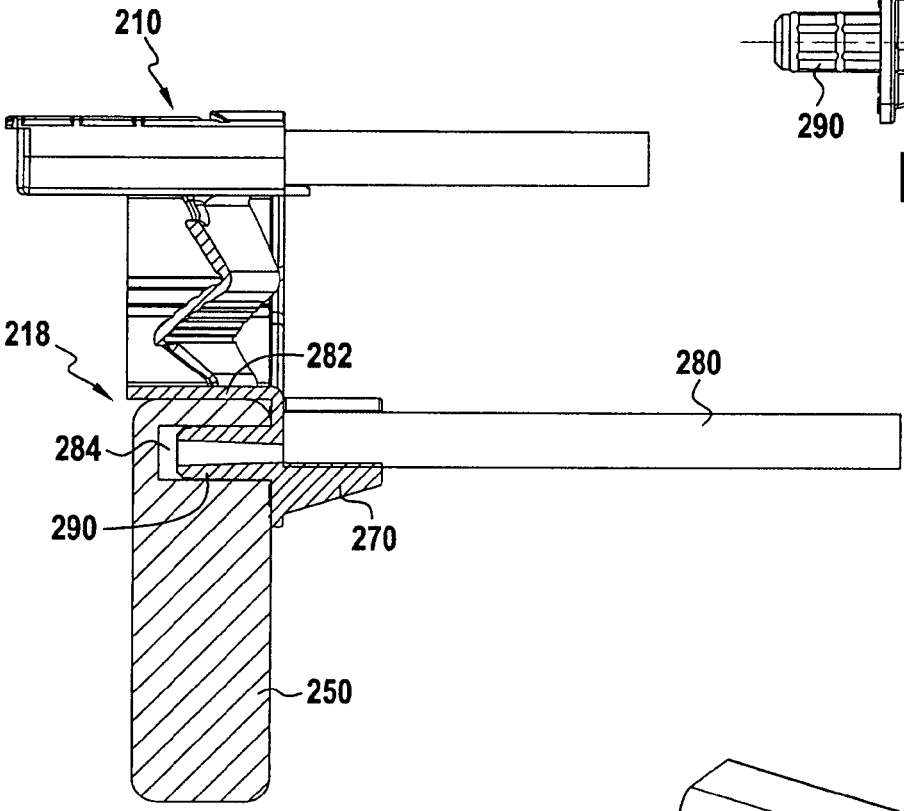
FIG. 14 is a view in section from the side of the end-piece shown in FIG. 13 when the latter is fixed to the side rail.

In this second variant, the anchoring means also comprise a support plate 282, which can be seen in FIG. 14 and which extends in a plane substantially parallel to the reference plane.

Figure 15:
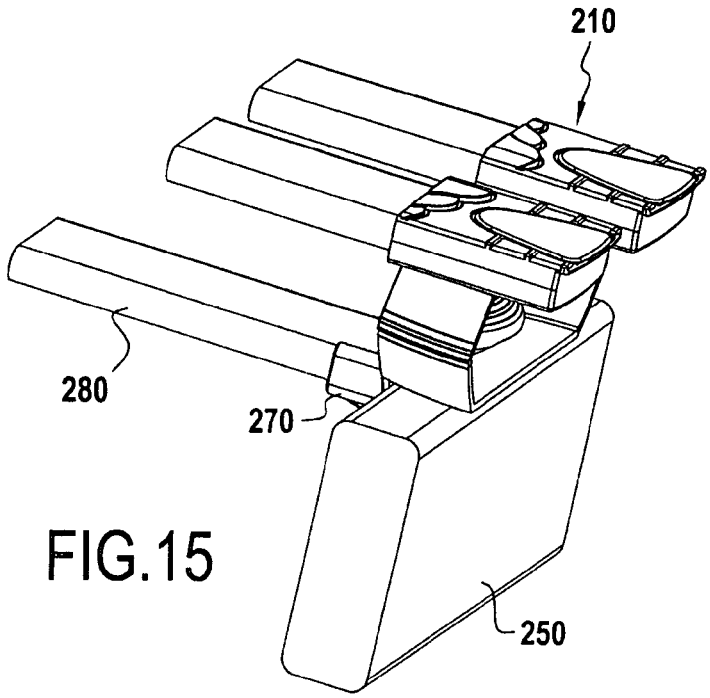
FIG. 15 is a perspective view of the end-piece shown in FIG. 13 when the latter is fixed to the side rail.

As can be seen by referring to FIGS. 14 and 15, the end-piece 200 is able to rest on the top edge of the side rail 250 via the support plate 282.

There is also a hole 284 provided in the side rail to receive the single spigot 290.

As can be seen from FIG. 14, the width of the lower portion 218 of the end-piece 200 may be sized to be equal to the thickness of the side rail 250.

Finally, the additional receptacle 270 for the lower slat 280 is preferably so arranged as substantially to form a continuation of the single spigot 290.

The invention claimed is:

1. A device for suspending bed-base slats, formed by an end-piece which has an upper portion which comprises at least one receptacle to receive the end of a slat, a lower portion provided with a device for anchoring the said end-piece to a bed frame, and an intermediate portion comprising suspension members which connect the lower portion to the upper portion wherein the suspension members comprise at least one longitudinal wall which is capable of folding at at least one substantially longitudinally extending fold line, and a pair of transverse walls which are capable of folding at a substantially transversely extending fold line, and wherein the longitudinal wall is arranged substantially between the two transverse walls.

2. The suspension device according to claim 1, wherein, when seen in the transverse direction of the end-piece, the transverse span of the longitudinal wall, when it is folded or unfolded, is substantially equal to or slightly smaller than the width of the lower portion.

3. The suspension device according to claim 1 wherein, when seen in the transverse direction of the end-piece, the width of each of the transverse walls is substantially equal to or slightly smaller than the width of the lower portion.

4. The suspension device according to claim 1, wherein, when seen in the transverse direction of the end-piece, the longitudinal wall comprises at least one angled portion in such a way as to define the fold line.

5. The suspension device according to claim 4, wherein the angled portion is so orientated as to open towards the outside of the bed frame.

6. The suspension device according to claim 4 wherein the longitudinal wall also comprises a second angled portion which defines a second fold line, the said portion being so orientated that it opens towards the inside of the bed frame.

7. The device according to claim 1, wherein, when projected orthogonally onto a reference plane parallel to the slat, the fold line in the longitudinal wall is curved.

8. The device according to claim 1, wherein, when projected orthogonally onto a reference plane parallel to the slat, the fold line in the transverse wall is curved.

9. The suspension device according to claim 1, wherein the upper portion comprises two receptacles to receive the ends of two slats.

10. The suspension device according to claim 9, wherein the longitudinal wall also comprises two upper arms which are connected each to a respective one of the receptacles.

11. The suspension device according to claim 9 wherein the longitudinal wall also comprises two lower arms which are connected to the lower portion.

12. The device according to claim 9, wherein a supporting platform for a mattress is arranged above the two receptacles.

13. The device according to claim 9, wherein each of the receptacles comprises an extension which forms a supporting portion for a mattress.

14. The device according to claim 1, wherein the lower portion also comprises an additional receptacle to receive the end of a lower slat.

15. The device according to claim 1, wherein the anchoring device comprises at least one spigot which is intended to fit into a hole made in the bed frame.

16. The device according to claim 1, wherein the anchoring device comprises at least one sleeve to be fixed to a spigot secured to the bed frame.

* * * * *